US005129294A

United States Patent [19]

Boldrini et al.

[11] Patent Number: 5,129,294

[45] Date of Patent: Jul. 14, 1992

[54] METHOD OF REPLACING AND ADJUSTING PREPRINTED STRIP MATERIAL ON A MANUFACTURING MACHINE

[75] Inventors: Fulvio Boldrini, Ferrara; Antonio Gamberini, Bologna, both of Italy

[73] Assignee: G. D Societa' per Azioni, Bologna, Italy

[21] Appl. No.: 723,750

[22] Filed: Jul. 1, 1991

[30] Foreign Application Priority Data

Jul. 10, 1990 [IT] Italy ..... 3583 A/90

[51] Int. Cl.[5] ..... B26D 5/32; B26D 5/34

[52] U.S. Cl. ..... 83/13; 83/67; 83/371; 83/650; 83/949; 242/58

[58] Field of Search ..... 83/649, 650, 949, 371, 83/67, 13, 105, 106

[56] References Cited

U.S. PATENT DOCUMENTS

| | | | |
|---|---|---|---|
| 3,391,877 | 7/1968 | Angell et al. | 242/58.3 |
| 4,043,520 | 8/1977 | Olsson et al. | 242/58.3 X |
| 4,564,149 | 1/1986 | Barzano | 242/58.3 X |
| 4,694,714 | 9/1987 | Focke et al. | 83/650 X |
| 5,036,359 | 7/1991 | Duijve et al. | 242/58 X |

*Primary Examiner*—Frank T. Yost
*Assistant Examiner*—Kenneth F. Peterson
*Attorney, Agent, or Firm*—Marshall, O'Toole, Gerstein, Murray & Bicknell

[57] ABSTRACT

A method of replacing a first strip having equally-spaced preprinted graphics with a second identical strip on a manufacturing machine having an input traction unit for feeding the first strip along a first route defined by a first and second branch forming a given angle; the second strip, after being accelerated along the first branch and adjusted in relation to the first strip, being cut and fed on to the second branch by a spoon-shaped guide plate operating in a direction substantially coincident with that of the second branch.

5 Claims, 3 Drawing Sheets

METHOD OF REPLACING AND ADJUSTING PREPRINTED STRIP MATERIAL ON A MANUFACTURING MACHINE

BACKGROUND OF THE INVENTION

The present invention relates to a method of replacing and adjusting preprinted strip material on a manufacturing machine.

The present invention may be employed to advantage on packing machines in general and, in particular, on cigarette packing machines to which the following description refers purely by way of example.

Cigarette packing machines are known to employ, e.g. for coupons applied to the packs, preprinted strips of paper or similar printed at regular intervals with a sequence of identical graphics, each defining a coupon which is cut off the strip on the packing machine prior to being applied to the pack.

The preprinted strip is normally run off a reel which, as it is about to run out, is changed with a new one by means of splicing devices which provide for joining the end portion of the run-off strip to the lead portion of the new one, so as to make the changeover without stopping the machine. On known splicing devices, the run-off and run-on strips are usually fed along a common route portion immediately downstream from which a standby portion of variable length is provided enabling the run-off strip to be stopped along said common route portion, for adjusting the printed graphics and splicing the two stationary strips together.

One of the major drawbacks of known splicing devices of the aforementioned type is the relatively long distance covered by the strips between the reels and the user machine, and defined by said common route and standby portions, which standby portion is substantially used up at each splicing operation and, to be restored, requires that the packing machine be run at less than normal speed for a certain length of time after the strips are spliced.

Moreover, the length of said route subjects the strips to severe axial and transverse stress resulting in frequent tearing and loss of adjustment, and, in the event of the strips being torn, involves serious difficulties and relatively prolonged downtime for reassembling them.

SUMMARY OF THE INVENTION

It is an object of the present invention to provide a method of continuously adjusting and replacing preprinted strips, which method provides for splicing the strips without arresting the same, for eliminating the need for a standby portion, and for drastically reducing the distance traveled by the strips between the reels and user machine.

According to the present invention, there is provided a method of adjusting and replacing preprinted strip material on a manufacturing machine, in particular, for adjusting and replacing a first run-off strip having a regular sequence of preprinted graphics with an identical second preprinted strip on said manufacturing machine, said machine having an input traction unit for feeding said first strip to said machine along a predetermined route comprising a first and second branch forming a given angle, said traction unit being located along said second branch; said method being characterised by the fact that it comprises successive stages consisting in accelerating said second strip along a second route sharing said first branch with said first route, and until the speed of said second strip equals that of said first strip; in adjusting the preprinted graphics of said second strip in relation to said first strip; in cutting said first strip; in cutting said second strip by means of a first cutting device having a curved guide plate, activated in a direction substantially coincident with that of said second branch, so as to cut and feed said second strip along said second branch towards said traction unit and a second cutting device; and in removing said first strip by means of a disposal unit located between said traction unit and said second cutting device.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
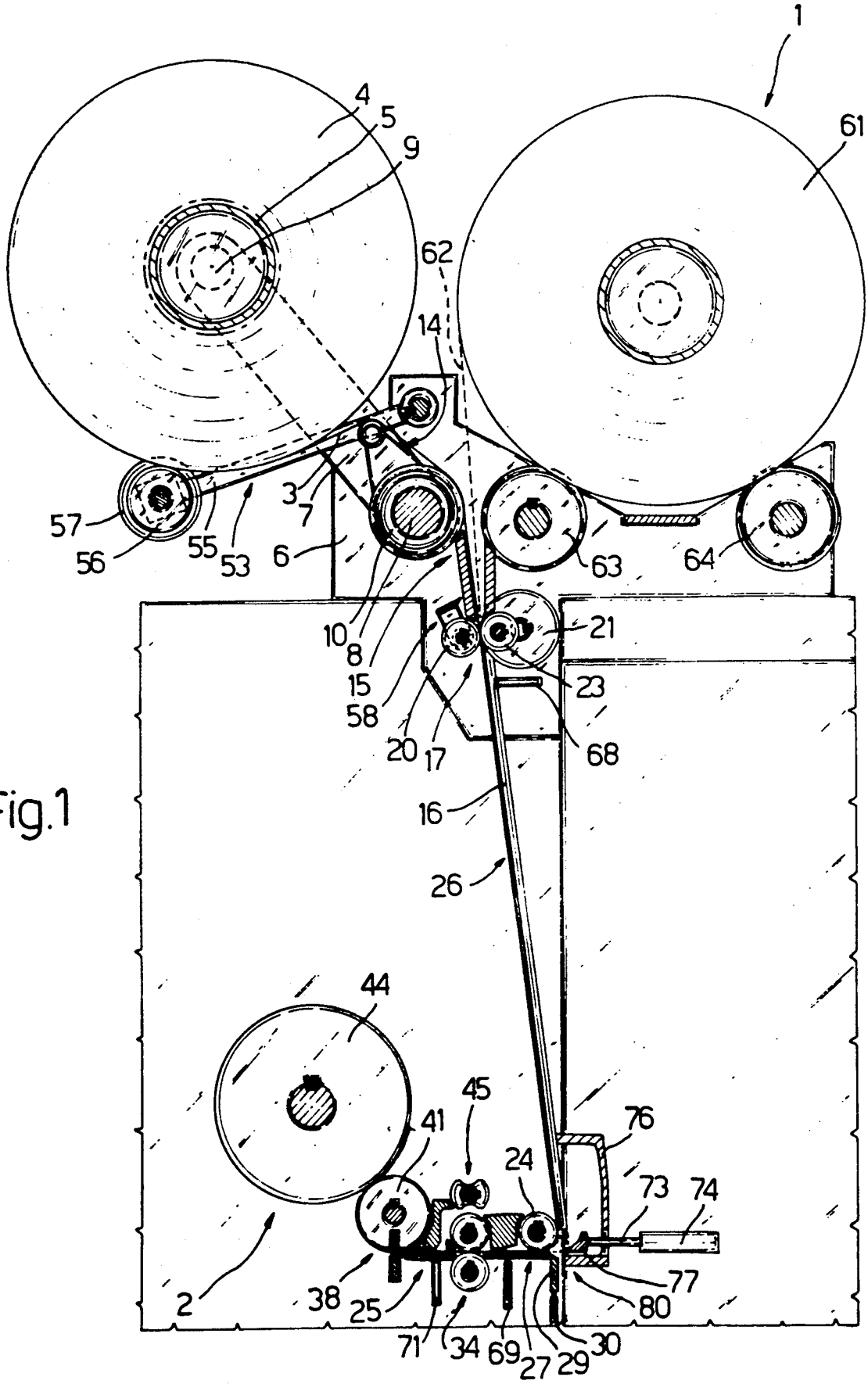
FIG. 1 shows a schematic view of a strip feed device implementing the method according to the present invention.

Number 1 in FIG. 1 indicates a device for feeding a packing machine 2 with a strip 3 of paper printed with a regular sequence of graphics (not shown). Strip 3 is run off a reel 4 having a central core 5 supported in rotary manner (counterclockwise in FIG. 1) on a bed 6 by means of an arm 7, the bottom end of which is fitted to a shaft 8 supported on bed 6 and perpendicular to the FIG. 1 plane. The top end of arm 7 is fitted with a cylindrical pin 9 engaged inside core 5.

Figure 2:
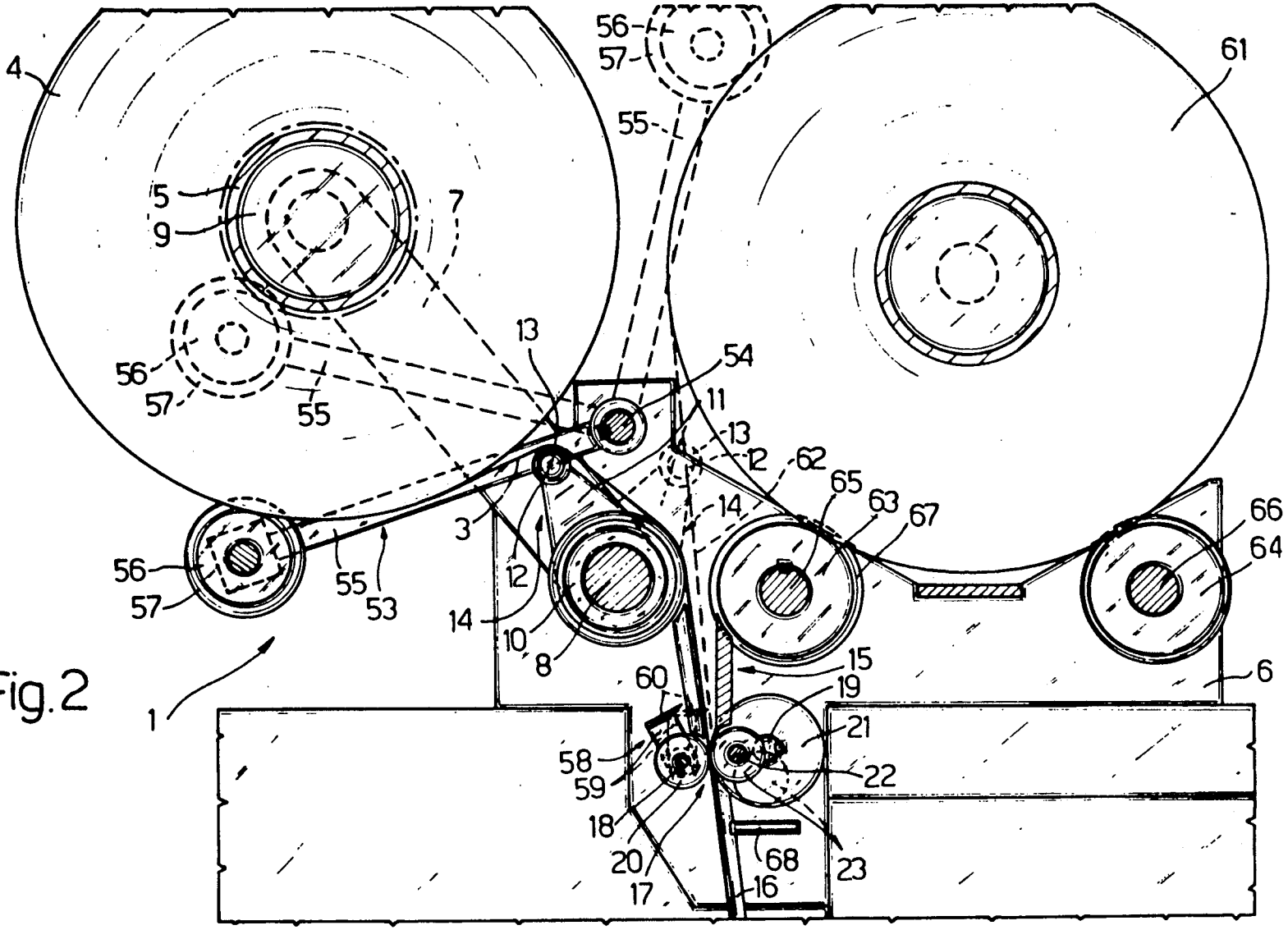
FIG. 2 shows a larger-scale view of a detail in FIG. 1 in two different operating positions.

As shown more clearly in FIG. 2, shaft 8 supports in idle manner a guide roller 10 and a lever 11 extending radially outwards from shaft 8 and fitted on its free end with a pin 12 parallel to shaft 8 and supporting an idle roller 13. Roller 13 and lever 11 combine to form a tensioning device 14 connected to bed 6 by elastic means (not shown) for rotating lever 11 clockwise about shaft 8, while guide roller 10 feeds strip 3 downwards so as to engage the input portion 15 of a guide 16.

Guide 16 is supported by bed 6 in a fixed, substantially vertical position, and is separated from input portion 15 by an accelerating device 17 (described later on) comprising two shafts 18 and 19 parallel to each other and to shaft 8, and located on opposite sides of strip 3, with shaft 18 on the same side as shaft 8. Device 17 also comprises an idle roller 20 on shaft 18; and a disk 21 fitted on to shaft 19 and supporting a powered eccentric shaft 22 parallel to shaft 19 and fitted with a roller 23 lying in the same plane as roller 20 and having known peripheral suction means (not shown).

Rotation of shaft 19 via actuating means (not shown) provides for moving powered roller 23 between an idle position wherein it is detached from roller 20, and a traction position wherein rollers 23 and 20 are substantially tangent to each other on opposite sides of strip 3.

Figure 3:
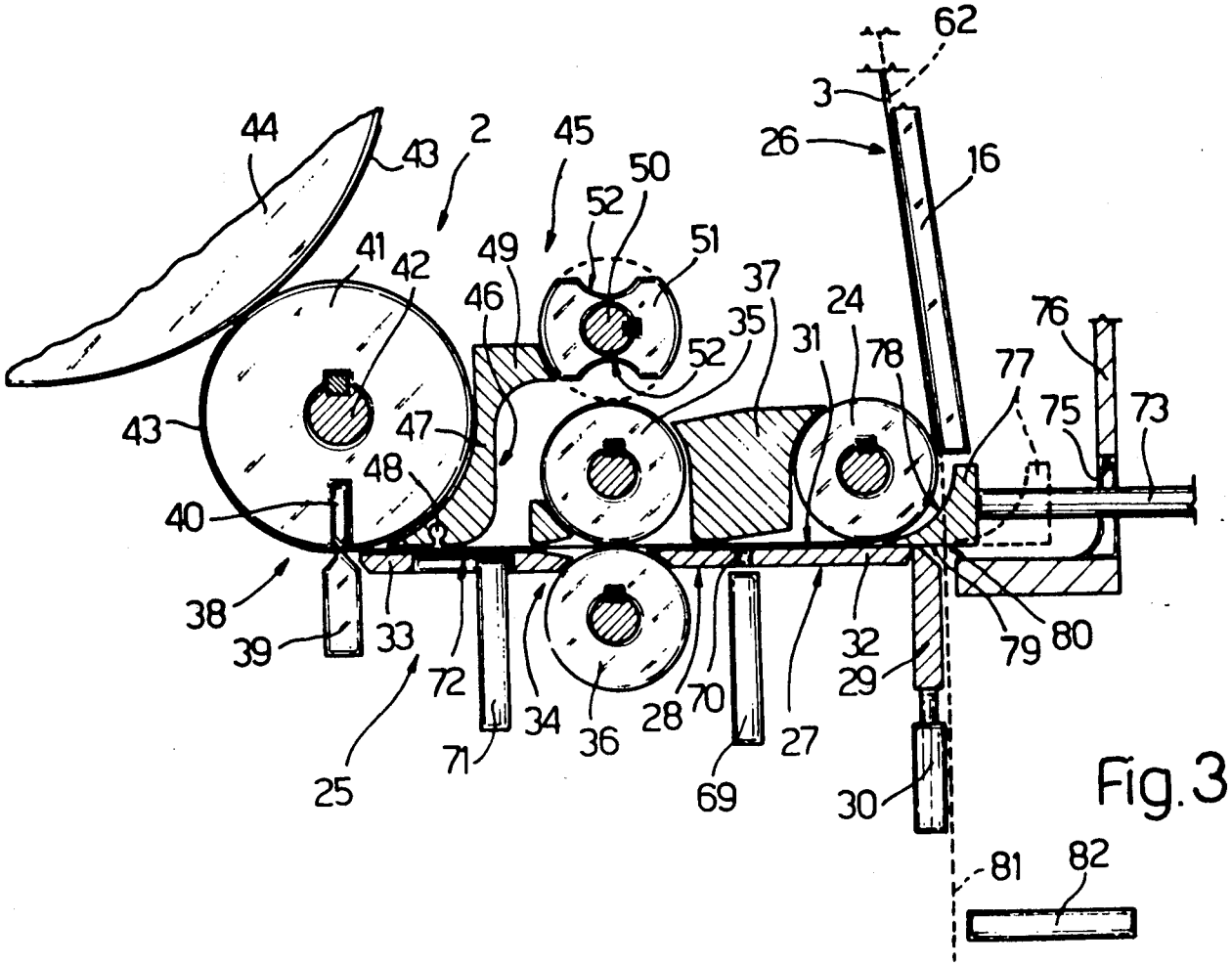
FIG. 3 shows a larger-scale view of a further detail in FIG. 1.

As shown more clearly in FIG. 3, the bottom end of guide 16 is tangent to a powered suction type guide roller 24 constituting the input roller of a traction unit 25 for feeding strip 3 on to machine 2.

Roller 24 defines the route by which strip 3 is fed on to machine 2, said first route comprising, commencing from guide roller 10, a first branch downward portion 26 extending along guide 16, and a second branch input portion 27 on to machine 2. Said route branch portions 26 and 27 are arranged at an angle and connected by a connecting portion defined along an outer peripheral portion of roller 24.

In the example shown, said angle is substantially a right angle covered by strip 3 winding about roller 24 into traction unit 25 by which it is fed in a substantially horizontal direction. Obviously, by varying the position of traction unit 25, the angle formed by branches 26 and 27 may be considerably more or less than 90°, but not too close to 180°.

As shown more clearly in FIG. 3, traction unit 25 comprises a substantially horizontal plate 28, the end of which, adjacent to guide 16, is connected to a substantially vertical cutting blade 29 moved up and down by an actuator 30 between a raised cutting position coplanar with the upper surface 31 of plate 28, and a lowered idle position.

Plate 28 is divided into two coplanar portions 32 and 33 by a traction unit 34 comprising two superimposed powered rollers 35 and 36 tangent to each other along a generating line coplanar to surface 31. Over portion 32 of plate 28, and substantially tangent to the periphery of both roller 35 and roller 24, there is provided a plate 37 (optional) for preventing strip 3 from winding upwards about roller 35 and bypassing a cutting unit 38 comprising a fixed bottom blade 39 and a rotary top blade 40 fitted to a suction roller 41 on a powered shaft 42. Cutting unit 38 is located immediately downstream from portion 33 of plate 28, for cutting strip 3 into portions 43 of the same length as the graphics (not shown) on strip 3, and feeding portions 43 in known manner to a transfer roller 44.

As shown in FIG. 3, over portion 33 of plate 28, there is provided a disposal unit 45 comprising a substantially L-shaped bracket 46, one branch 47 of which, extending upwards from portion 33, is fitted on the end facing portion 33 with a suction device 48 for braking and arresting strip 3. Bracket 46 also comprises a second branch 49 extending from the top end of branch 47, over traction unit 34, and supporting a powered shaft 50 fitted with a disposal roller 51 tangent to roller 35 and having two diametrically-opposed recesses 52 described later on.

As shown in FIG. 1, reel 4 is provided with a device 53 for detecting the amount of strip 3 remaining, at all times, on reel 4. Detecting device 53 comprises a shaft 54 mounted for rotation through bed 6 and fitted with a lever 55, the free end of which supports a rotary feeler roller 56 maintained contacting the periphery of reel 4 by elastic means (not shown) located between lever 55 and bed 6, and having peripheral flanges 57 for continuously controlling and guiding strip 3 as it is fed off reel 4.

On reaching an angular position wherein roller 56 substantially contacts the outer periphery of core 5, shaft 54, via a control (not shown) normally consisting of a microswitch, activates the actuating device (not shown) of a cutting unit 58 comprising a lever 59 fitted on to shaft 18, and a transverse blade 60 integral with the free end of lever 59. Said actuating device (not shown) is assigned to shaft 18 and provides, when activated, for rotating shaft 18 and lever 59 clockwise for cutting strip 3 by means of blade 60. A second reel 61 for a second strip 62 identical to strip 3 is set up on bed 6 beside reel 4, and supported in rotary manner on a saddle defined by two rollers 63 and 64, the first of which is a powered roller fitted on to a drive shaft 65, while the second is mounted in idle manner on a pin 66. Roller 63 presents two outer flanges 67 (only one of which is shown) for transversely guiding reel 61 as it turns (counterclockwise in FIG. 1) in relation to bed 6.

Branch 26 of the route by which strip 3 is fed to machine 2 presents a first optical sensor 68, normally a photocell, facing strip 62 and located a given distance, normally equal to a multiple of the length of said printed graphic, from a second optical sensor 69 located on branch 27, facing a hole 70 formed through portion 32 of plate 28. A third sensor 71 is located facing an opening 72 formed through portion 33 of plate 28, immediately upstream from suction device 48.

The rod 73 of an actuator 74 is mounted facing the input edge of plate 28, and is moved by actuator 74 through an opening 75 in a protection element 76 integral with guide 16, and in a direction perfectly aligned and coincident with branch 27 of the route of strip 3. The free end of rod 73 is fitted with a curved plate 77 defined, at the top, by a cylindrical surface 78 having substantially the same radius as the outer surface of roller 24, and, at the bottom, by a flat surface 79 substantially coplanar with surface 31 of plate 28.

Together with blade 29, curved plate 77 forms a device 80 for cutting and guiding strip 62, and is moved by actuator 74 between a withdrawn position, wherein curved plate 77 is located on the opposite side of guide 16 in relation to roller 24, and a forward position wherein curved plate 77 is located partially over surface 31 of plate 28, with surface 79 contacting blade 29 in the lowered position, and surface 78 substantially contacting the outer surface of roller 24.

Under normal operating conditions, strip 3 is reeled off by traction unit 34 driven by the main motor (not shown) on packing machine 2, and is fed about roller 24, on to machine 2, and along surface 31 of plate 28 on branch 27 to cutting unit 38 by which it is cut into portions 43. Under normal operating conditions, a standby reel 61 is fed in known manner on to rollers 63 and 64, and roller 63 is activated for reeling off part of strip 62, the leading portion 81 of which (FIG. 3) is fed downwards in the gap between strip 3 and guide 16 so as to engage accelerating device 17. Once past roller 24, leading portion 81 of strip 62 is detected by a sensor 82, which arrests roller 63. As strip 3 is wound off reel 4, feeler roller 56 gradually works its way towards core 5 until, when only a few turns of strip 3 are left on core 5, shaft 54 activates roller 63 and accelerating device 17, which gradually accelerates strip 62 until it travels along branch 26 at the same speed as strip 3. For this purpose, shaft 19 is activated so as to turn disk 21 clockwise (in FIG. 2) and bring roller 23 into contact with the periphery of roller 20, with strips 3 and 62 in between. Rotation of shafts 19 and 22 is controlled by sensors 68 and 69 so as, not only to bring strip 62 up to the same speed as strip 3, but also to match the graphics on strip 62 with those on strip 3.

This is achieved, as already stated, by virtue of sensors 68 and 69 along the route of strip 3 being separated by a distance equal to a multiple of the length of the graphics on strips 3 and 62. Sensors 68 and 69 provide for emitting signals as a function of the passage of given references on the graphics of respective facing strips 62 and 3, which signals are only emitted simultaneously when the graphics of both strips 3 and 62 match. In the event of other than simultaneous emission of said signals, a signal indicating misadjustment of accelerating device 17 is emitted by a known receiving device (not shown) connected to sensors 68 and 69.

Once the graphics on strips 3 and 62 are matched, said receiving device activates both unit 58, which cuts off the run-out strip 3, and actuators 30 and 74, which raise blade 29 until its cutting edge is coplanar with surface 31 and, at the same time, move plate 77 from the withdrawn idle position (shown by the dotted line in FIG. 3) to the forward operating position (shown by the continuous line in FIG. 3) wherein surface 78 of plate 77 is positioned substantially contacting guide roller 24, the outer surface of which provides for connecting branches 26 and 27.

As it moves into the operating position, bottom surface 79 of curved plate 77 slides over the cutting edge of blade 29 to detach end portion 81 of strip 62 extending downwardly past plate 28, and gradually feed the so formed cut end of strip 62 between roller 24 and plate 28.

The end of strip 62 and the trailing end of strip 3 are then fed together along plate 28 to engage traction unit 34, and past sensor 71 to cutting unit 38. On detecting the passage of the end of strip 62, sensor 71 activates both suction device 48 and shaft 50 of disposal unit 45, so as to turn roller 51 counterclockwise in FIG. 3.

As shown schematically in FIG. 3, suction device 48 comprises one or more holes formed in bracket 46 along branch 27 and communicating with a suction source (not shown) which, when activated, sucks strip 3 on to bracket 46 and acts as a brake for arresting the passage of strip 3 towards cutting unit 38. Strip 3 is arrested as the end of strip 62 reaches cutting unit 38 and, as traction unit 34 continues feeding the end of strip 3 forward, forms an upward loop contacting bracket 46 and eventually engaging one of recesses 52 on roller 51, rotation of which expels the end of strip 3 from traction unit 25.

Clearly, therefore, in view of the angle formed by branches 26 and 27 of the route along which strip 3 or 62 is fed on to machine 2, cutting device 80 comprising curved plate 77 operating in line with input branch 27 to machine 2 provides, simultaneously in one movement, for cutting and feeding the end of the new strip 62 along branch 27 on to machine 2 without stopping or slowing down the same, while traction unit 34 between cutting device 80 and cutting unit 38 provides for automatically disposing of the trailing end of run-out strip 3 as the new strip 62 reaches cutting unit 38.

We claim:

1. A method of adjusting and replacing preprinted strip material on a manufacturing machine, in particular for adjusting and replacing a first run-off strip (3), having a regular sequence of preprinted graphics, with a second strip (62) having preprinted graphics identical to the graphics on the first strip (3), said manufacturing machine (2) having an input traction unit (34) for feeding the first strip (3) to the machine (2) at a given speed along a predetermined first route comprising a first branch and a second branch (26,27) forming a given angle, said traction unit (34) being located along said second branch (27), the method comprising:

positioning the second strip (62) in overlapping position relative to the first strip (3) along a second route which shares the first branch (26) with the first route, and accelerating the second strip (62) until the second strip (62) reaches a speed equal to the speed of the first strip (3);

adjusting the second strip (62) relative to the first strip (3) so that the preprinted graphics on the second strip (62) are in proper relation to the graphics on the first strip (3);

cutting the first strip (3) thereby leaving an end of the first strip (3) overlapping the second strip (62);

cutting the second strip (62) by means of a first cutting device (80) having a curved guide plate (77) activated in a direction substantially coincident with that of the second branch (27) so as to cut the second strip (62) and form a second strip (62) front end overlapping the first strip (3) end;

feeding both the end of the first strip (3) and said second strip (62) front end in overlapping arrangement along the second branch (27) towards the traction unit (34) and towards the second cutting device (38);

when the front end of the second strip (62) reaches the second cutting device (38), cutting off the end of the first strip (3) overlapping the second strip (62) by means of the second cutting device (38); and removing and disposing of the said cut-off end of the first strip (3) from between the traction unit (34) and the second cutting device (38).

2. A method according to claim 1 in which:

the second cutting unit (38) cooperates with said strip (3,62) for producing strip portions (43) of constant length; and adjusting the second strip (62) relative to the first strip (3) by means reponsive to first and second sensors (68,69) located along said first route and separated by a distance equal to a multiple of the length of the strip portions (43).

3. A method according to claim 2 including adjusting the second strip (62) relative to the first strip (3) by means responsive to the first and second sensors (68,69) with the sensors located respectively along the first and second branches (26,27) and with the first sensor (68) positioned facing the second strip (62).

4. A method according to claim 1 in which the removing and disposing of the cut-off end of the first strip (3) includes:

arresting the first strip (3) via braking means (48) along the second branching (27) downstream from the traction unit (34) and upstream from the second cutting device (38);

feeding a portion of the first strip (3) forward by means of the traction unit (34) located upstream from the braking means (48) so as to form the cut-off end of the first strip (3) into a loop; and removing and disposing of the loop by engaging the loop with extracting means (51).

5. A method according to claim 1 in which:

the curved guide plate (77) has a curved surface (78); and the guide plate (77) is moved to an operating position at which the curved surface (78) substantially contacts an outer surface of a guide roller (24) connecting the first and second branches (26,27) to guide the front end of the second strip (62) into the second branch (27).

* * * * *